US009991610B2

(12) United States Patent
Kurita

(10) Patent No.: US 9,991,610 B2
(45) Date of Patent: Jun. 5, 2018

(54) CONTACT MEMBER

(71) Applicant: Kitagawa Industries Co., Ltd., Aichi (JP)

(72) Inventor: Tomohisa Kurita, Aichi (JP)

(73) Assignee: KITAGAWA INDUSTRIES CO., LTD., Aichi (JP)

( * ) Notice: Subject to any disclaimer, the term of this patent is extended or adjusted under 35 U.S.C. 154(b) by 0 days. days.

(21) Appl. No.: 15/565,734

(22) PCT Filed: Jun. 8, 2016

(86) PCT No.: PCT/JP2016/067148
§ 371 (c)(1),
(2) Date: Oct. 11, 2017

(87) PCT Pub. No.: WO2016/199832
PCT Pub. Date: Dec. 15, 2016

(65) Prior Publication Data

US 2018/0076535 A1 Mar. 15, 2018

(30) Foreign Application Priority Data

Jun. 12, 2015 (JP) ..... 2015-119364

(51) Int. Cl.
*H01R 12/10* (2006.01)
*H01R 4/48* (2006.01)
(Continued)

(52) U.S. Cl.
CPC ..... *H01R 4/48* (2013.01); *H01R 12/52* (2013.01); *H01R 12/57* (2013.01)

(58) Field of Classification Search
CPC ..... H01R 12/57; H01R 13/24
(Continued)

(56) References Cited

U.S. PATENT DOCUMENTS 5,574,384 A * 11/1996 Oi ..... G01R 31/2817 324/750.05
5,655,913 A * 8/1997 Castaneda ..... H01R 12/57 439/66
(Continued)

FOREIGN PATENT DOCUMENTS

JP H08287980 A 11/1996
JP 2000223173 A 8/2000
(Continued)

OTHER PUBLICATIONS

International Preliminary Report on Patentability dated Dec. 21, 2017, from International Application No. PCT/JP2016/067148, 5 pages.
(Continued)

*Primary Examiner* — Neil Abrams
(74) *Attorney, Agent, or Firm* — Meunier Carlin & Curfman LLC

(57) ABSTRACT

A pair of solder bonding portions to be solder-bonded onto the printed wiring board and a contact portion to contact the different conductive member or the like are coupled by a pair of flat spring portions. The respective flat spring portions protrude from side surfaces of mutually opposed corners of the contact portion. Sections following protruded sections of the respective flat spring portions are bent so as to wind in the same direction around a pillar-shaped space obtained by projecting the contact portion downward, and the flat spring portions reach the corresponding solder bonding portions. When the contact portion is pressed by the conductive member, the contact portion and the solder bonding portions remain parallel to each other, whereby the contact member can be successfully flattened toward the printed wiring board. At this point, outward deformation of the flat spring portions is inhibited.

5 Claims, 5 Drawing Sheets

(51) Int. Cl.
*H01R 12/52* (2011.01)
*H01R 12/57* (2011.01)

(58) Field of Classification Search
USPC ..... 439/862
See application file for complete search history.

(56) References Cited

U.S. PATENT DOCUMENTS 5,810,609 A * 9/1998 Faraci ..... H05K 3/326 228/180.22
6,051,781 A * 4/2000 Bianca ..... H05K 9/0016 174/250
6,359,455 B1 * 3/2002 Takekoshi ..... G01R 1/06727 324/755.05
6,482,013 B2 * 11/2002 Eldridge ..... B23K 20/004 324/755.05
6,520,778 B1 * 2/2003 Eldridge ..... H01L 21/67288 257/E23.021
6,705,876 B2 * 3/2004 Eldridge ..... G01R 1/0466 324/750.26
6,724,203 B1 * 4/2004 Goldmann ..... G01R 1/06755 324/750.05
6,811,406 B2 * 11/2004 Grube ..... H01R 12/57 439/197
6,898,087 B1 * 5/2005 Chen ..... H01R 13/2407 174/138 G
7,167,379 B2 * 1/2007 DiBene, II ..... G06F 1/18 257/691
7,189,077 B1 * 3/2007 Eldridge ..... G01R 3/00 257/E21.582
7,553,165 B2 * 6/2009 Mathieu ..... G01R 3/00 439/66
7,972,186 B2 * 7/2011 Tsao ..... H01R 12/585 439/876
8,052,428 B2 * 11/2011 Tsao ..... H01R 13/24 439/66
8,162,673 B2 * 4/2012 Chen ..... H05K 9/0064 439/66
8,179,692 B2 * 5/2012 Ihara ..... H01L 24/13 257/696
8,569,626 B2 * 10/2013 Kurita ..... H01R 12/57 174/94 R
8,668,529 B2 * 3/2014 Park ..... H01R 12/714 439/700
8,911,242 B2 * 12/2014 Jeon ..... H01R 13/2442 439/66
8,926,338 B2 * 1/2015 Kiryu ..... H01R 13/24 439/66
9,240,645 B1 * 1/2016 Ma ..... H01R 13/2492
9,450,294 B2 * 9/2016 Cho ..... H01Q 1/243
9,570,827 B2 * 2/2017 Kurita ..... H01R 13/15
9,787,011 B2 * 10/2017 Kurita ..... H01R 13/02
9,912,090 B2 * 3/2018 Yokota ..... H01R 13/2407
2010/0068901 A1 * 3/2010 Yumi ..... H01R 13/03 439/78
2012/0302109 A1 * 11/2012 Qu ..... H01R 12/57 439/884
2017/0288329 A1 * 10/2017 Kurita ..... H01R 12/718
2018/0076535 A1 * 3/2018 Kurita ..... H01R 4/48

FOREIGN PATENT DOCUMENTS

JP 3103271 U 8/2004
JP 2011124200 A 6/2011
JP 2016115549 A 6/2016

OTHER PUBLICATIONS

International Search Report dated Aug. 30, 2016, from International Application No. PCT/JP2016/067148, 2 pages.

* cited by examiner

REAR
FRONT
LEFT
RIGHT
UP
DOWN

REAR
FRONT
LEFT
RIGHT
UP
DOWN
101
3
31
31A
32
33
71
72
75
105
107

REAR
FRONT
LEFT
RIGHT
UP
DOWN
201
203
203A
205
207

CONTACT MEMBER

TECHNICAL FIELD

The present disclosure relates to a contact member that is surface-mounted onto a mounting target surface of a printed wiring board and that is sandwiched between the printed wiring board and a conductive member, which is different from the printed wiring board, to thereby electrically connect a conductive pattern of the printed wiring board and the conductive member to each other.

BACKGROUND ART

Conventionally proposed as a contact member of this kind is a contact member comprising: a contact portion formed in a flat plate shape with one surface thereof serving both as a surface to contact a conductive member and as a surface to be sucked by a suction nozzle of an automatic mounter; a solder bonding portion to be solder-bonded onto a conductive pattern; and a flat spring portion coupling the contact portion and the solder bonding portion, both of which being moved in a plate thickness direction to be kept parallel to each other. The contact member as configured above is used such that a surface (hereinafter also referred to as an undersurface) opposite from where the flat spring portion and the contact portion are positioned in the solder bonding portion is solder-bonded onto the conductive pattern of a printed wiring board, and that the above-described one surface (that is, a top surface) of the contact portion is brought in contact with the conductive member such as a grounding conductor.

When the contact member is used with its flat spring portion elastically deformed, the contact portion is brought in press contact with the conductive member, whereby the conductive pattern of the printed wiring board and the conductive member can be electrically connected to each other. Further, in a case where the contact member of this kind is sucked by the suction nozzle of the automatic mounter and automatically mounted onto the printed wiring board, the above-described one surface of the contact portion can be used as the surface to be sucked by the suction nozzle.

A configuration as described in Patent Document 1, for example, is proposed in which specific shapes of the solder bonding portion, the flat spring portion, and the contact portion are shown. Specifically, in the proposed configuration, the flat spring portion is arranged to tilt from one side of the solder bonding portion formed in a rectangle-like plate shape in a way such as bending back at an acute angle toward a top surface of the solder bonding portion, and at an end of the flat spring portion, the contact portion formed in a rectangle-like plate shape is provided in parallel with the solder bonding portion.

PRIOR ART DOCUMENTS

Patent Documents

Patent Document 1: Japanese Unexamined Patent Application Publication No. H08-287980

SUMMARY OF THE INVENTION

Problems to be Solved by the Invention

However, in the configuration described in Patent Document 1, while the contact portion is being pressed by the conductive member, a corner section as a boundary section between the contact portion and the flat spring portion is brought in contact with the conductive member. Then, an end of the contact portion comes in contact with the solder bonding portion and the contact member as a whole takes a triangle shape in side view. At this point, it is difficult to allow the contact member to be further flattened toward the printed wiring board.

Even in the configuration described in Patent Document 1, if pressure is applied that is strong enough to cause permanent distortion to the contact member, the contact member can be further flattened as much as possible. In such a case, however, a function of the conductive member to electrically connect the conductive pattern and the conductive member is drastically degraded. The term "flatten" as used herein refers to making the contact member flatter to an extent that the contact member can return to its original shape due to elasticity of a metal forming the contact member.

It also can be considered that the top surface of the solder bonding portion is used as the surface to be sucked by the suction nozzle and that the flat spring portion is protruded upward at an obtuse angle from one side of the solder bonding portion so as to be brought in contact with the conductive member. In such a case, it is easy to allow the contact member to be flattened toward the printed wiring board such that a thickness of the contact member becomes substantially the same as the plate thickness. However, in such a way, while the flat spring portion is being pressed by the conductive member, an area of the conductive member as projected on the printed wiring board increases. As a result, in case of using the contact member having such a configuration, a mounting area of the contact member increases.

Moreover, in the case where the top surface of the solder bonding portion is used as the surface to be sucked, it is necessary to secure a sufficient area of the solder bonding portion so that an outer circumference of the suction nozzle does not interfere with the flat spring portion. When the top surface of the contact portion is used as the surface to be sucked as described in Patent Document 1, it is acceptable to make a side of the surface longer than an inner diameter of the suction nozzle (that is, a hole diameter). On the contrary, when the top surface of the solder bonding portion is used as the surface to be sucked, it is necessary to make a side of the top surface longer than an outer diameter of the suction nozzle. Accordingly, the mounting area of the contact member further increases.

Given such situations as described so far, it is desirable to allow the contact member, which is surface-mounted onto the printed wiring board and sandwiched between the printed wiring board and a different conductive member, to have a small mounting area. It is also desirable to allow the mounted contact member to be successfully flattened toward the printed wiring board.

Means for Solving the Problems

A contact member to be described hereinafter is formed by bending a thin metal plate, the contact member being surface-mounted onto a mounting target surface of a printed wiring board when in use and being sandwiched between the printed wiring board and a conductive member, which is different from the printed wiring board, to thereby electrically connect a conductive pattern of the printed wiring board and the conductive member to each other. The contact member comprises: a contact portion formed in a flat plate shape with one surface thereof serving both as a surface to contact the conductive member and as a surface to be sucked by a suction nozzle of an automatic mounter; a plurality of flat spring portions protruding from a plurality of respective places on side surfaces of the contact portion, sections following protruded sections of the respective flat spring portions being arranged so as to wind in a same direction around a pillar-shaped space obtained by projecting the contact portion in a direction from the one surface of the contact portion toward the other surface, each flat spring portion tilting as a whole in the direction from the one surface toward the other surface; and a solder bonding portion arranged at an end section of each flat spring portion on a side opposite from the corresponding protruded section, the solder bonding portion being formed in a flat plate shape parallel to the contact portion and being solder-bonded onto the conductive pattern.

The contact member having the above-described structure is surface-mounted onto the printed wiring board by directing the direction from the above-described one surface toward the other surface to a direction from the contact member toward the printed wiring board (hereinafter referred to as a downward direction). In this way, the contact portion and the solder bonding portions are positioned on respective planes orthogonal to upward and downward directions, and the solder bonding portion is arranged lower than the contact portion.

Under such conditions, when the solder bonding portion is solder-bonded onto the conductive pattern of the printed wiring board, the contact portion is supported above the printed wiring board via the plurality of flat spring portions tilting as a whole in the upward and downward directions. While the contact portion is being pressed by the conductive member, the respective flat spring portions are elastically deformed and the contact portion is brought in press contact with the conductive member.

The respective flat spring portions protrude from the plurality of respective places on the side surfaces of the contact portion and the sections following the corresponding protruded sections are arranged so as to wind in the same direction around the pillar-shaped space obtained by projecting the contact portion downward. Thus, an area of the contact member as projected on the printed wiring board is successfully inhibited from increasing by the deformation of the flat spring portions. Moreover, in such a contact member, if the one surface (that is, a top surface) of the contact portion is larger than a hole of the suction nozzle, the contact member can be successfully sucked by the suction nozzle. Accordingly, use of this contact member can successfully make a mounting area required smaller.

Also, the flat spring portions having such the above-described shapes make the contact portion move downward with its position parallel to the solder bonding portions maintained when the contact portion is pressed by the conductive member. This inhibits contact of the contact portion with the solder bonding portions and so on in the process of the pressing, as in case of a structure described in Patent Document 1. As a result, the mounted contact member can be successfully flattened toward the printed wiring board. Furthermore, as described above, the contact portion and the solder bonding portions remain parallel to each other, whereby defects of the contact member, such as permanent deformation, can be inhibited.

In this contact member, it is easy to design the contact portion to be arranged immediately above the center of gravity of the contact member, which can successfully inhibit the contact member from tilting while being sucked and transferred by the suction nozzle of the auto mounter. Further, in this contact member, since the respective flat spring portions are arranged bent so as to wind around the above-described pillar-shaped space, it is easy to design the flat spring portion to have a longer length with respect to the same mounting area.

In case of the above-described contact member, in sectional shapes of respective sections of each flat spring portion, a width in a direction along the one surface may be larger than a thickness in a direction along an axis of the pillar-shaped space. In such a case, the contact member can be flattened more successfully.

The solder bonding portion may be provided for each flat spring portion. Each flat spring portion and the corresponding solder bonding portion as a whole may take the same shape and the same arrangement as those rotated by 360/n degrees (n is an integer equal to or greater than 2) around an axis standing orthogonally to the one surface and passing the center of the contact portion. The solder bonding portions may be provided independently of each other at the end sections of the corresponding flat spring portions. In such a case, since the solder bonding portions are provided independently of each other for the corresponding flat spring portions, the mounting area of the contact member can be more successfully reduced. Also, since the contact member as a whole takes substantially the same shape as that when rotated by 360/n degrees around the above-described axis, the structure is simplified and easily designed. In this case, moreover, when the contact portion is pressed by the conductive member, the contact portion and the solder bonding portions are more successfully kept parallel to each other, whereby the contact member can be successfully flattened toward the printed wiring board. The above-mentioned n may not necessarily equal to a number of the flat spring portions.

The above-described solder bonding portion may comprise an extension portion that is extended in a direction protruding from a side surface of a main body of the solder bonding portion, wherein the main body is a target of solder application and the extension portion is not a target of solder application. Each end section of the corresponding flat spring portion may be connected to the extension portion. In this case, even if solder protrudes from and solidifies outside an undersurface of the main body of the solder bonding portion, the protruded solder is inhibited from reaching the end section of the flat spring portion. For this reason, redundant solder can be inhibited from affecting the deformation of the flat spring portion, which improves a restoration rate of the flat spring portion.

A rigidity of each flat spring portion may increase continuously or in steps throughout from the protruded section toward the end section. In such a case, since warpage caused by the elastic deformation of each flat spring portion is absorbed on a side near the above-described protruded section, that is, on an inner side of the contact member, the respective flat spring portions are more successfully inhibited from deforming in an outward direction (that is, in a direction in which the mounting area of the contact member increases). Accordingly, the mounting area of the contact member can be more successfully reduced.

is a front view, (C) is a bottom view, (D) is a right side view, (E) is an upper right perspective view, and (F) is a lower right perspective view.

Figure 2:
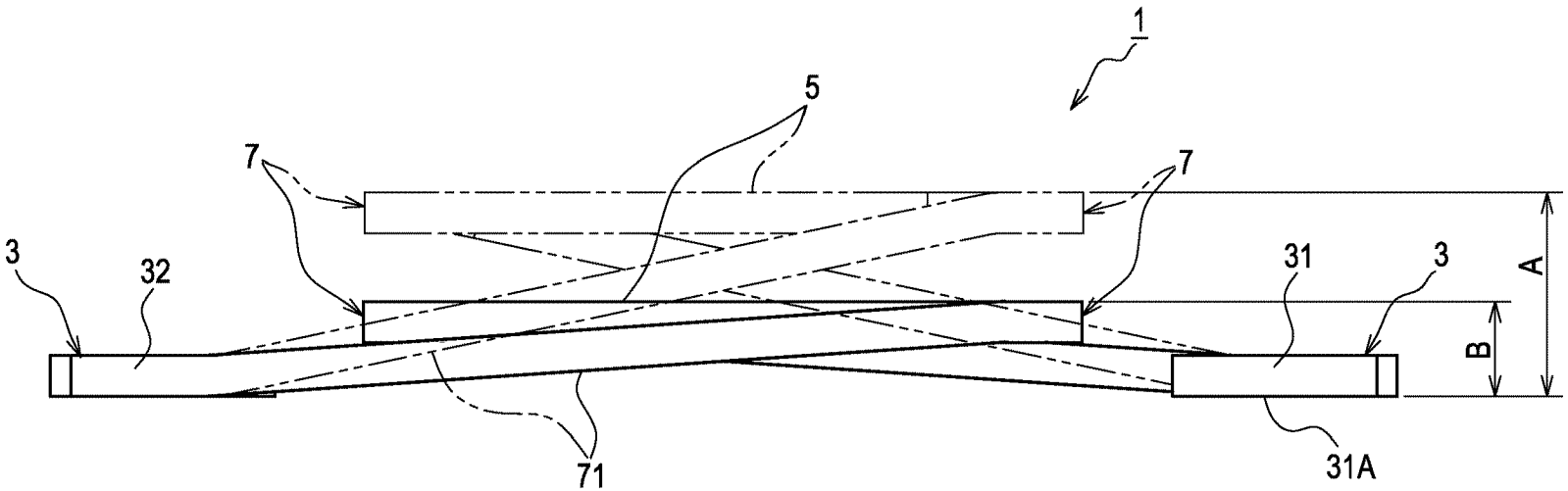

FIG. 2 is a front view showing a deformation behavior of the contact member.

Figure 3A:
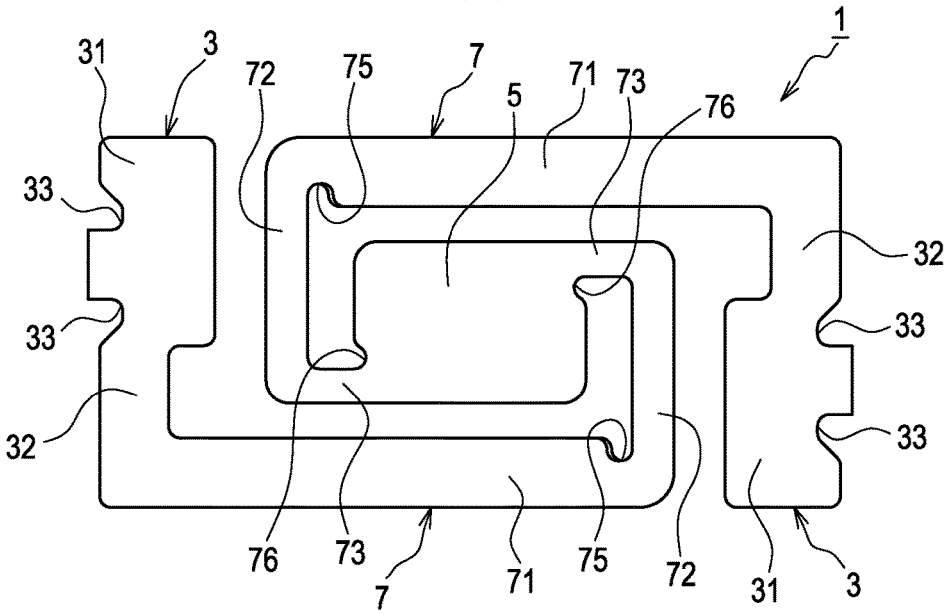
Figure 3B:
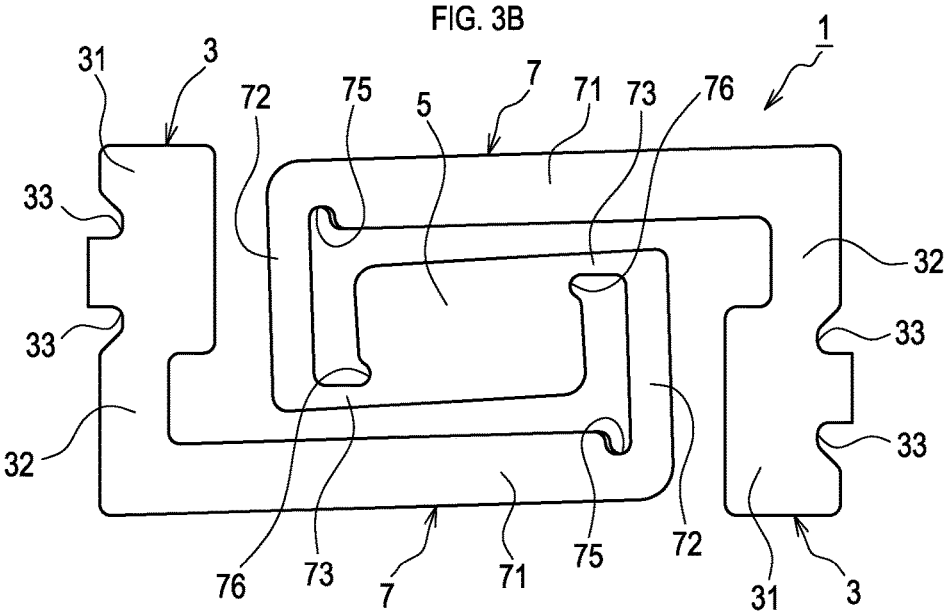

FIG. 3 is a plan view showing the deformation behavior of the contact member, where (A) shows a state of the member before the deformation, and (B) shows a state after the deformation.

Figures 4A, 4B, 4C, 4D, 4E, 4F:
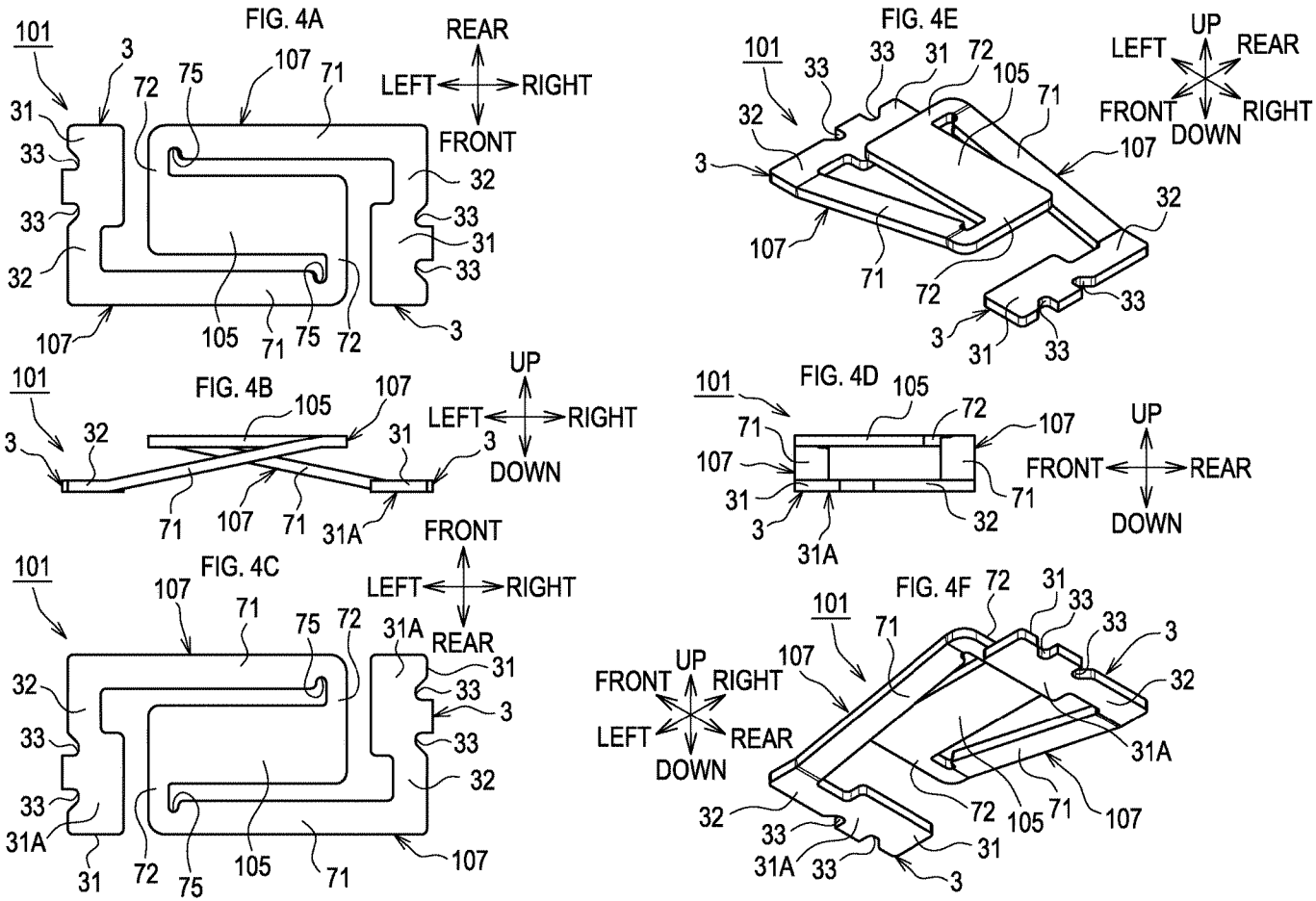

FIG. 4 is a drawing showing a structure of a contact member according to a second embodiment to which the present disclosure is applied, where (A) is a plan view, (B) is a front view, (C) is a bottom view, (D) is a right side view, (E) is an upper right perspective view, and (F) is a lower right perspective view.

Figures 5A, 5B, 5C, 5D, 5E, 5F:
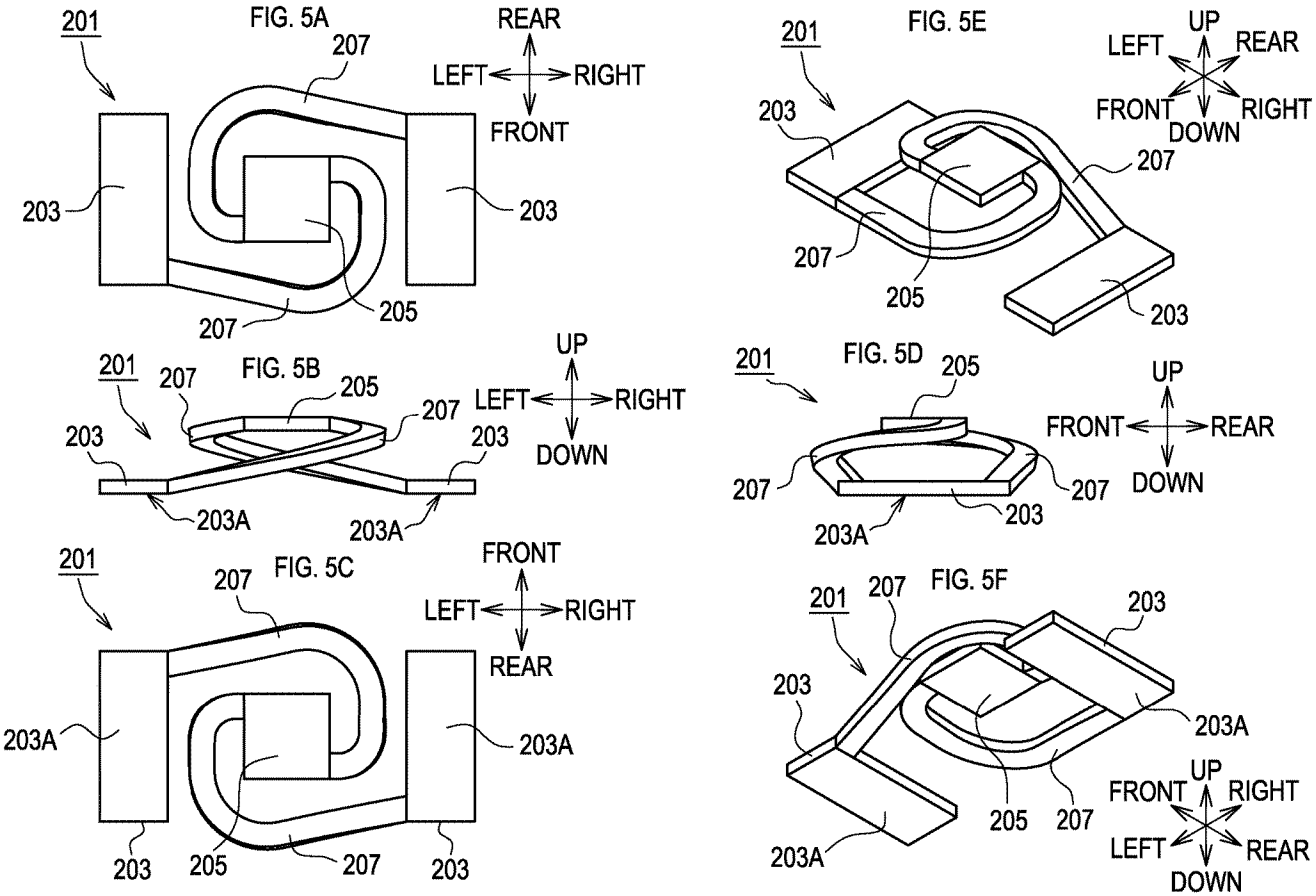

FIG. 5 is a drawing showing a structure of a contact member according to a third embodiment to which the present disclosure is applied, where (A) is a plan view, (B) is a front view, (C) is a bottom view, (D) is a right side view, (E) is an upper right perspective view, and (F) is a lower right perspective view.

MODE FOR CARRYING OUT THE INVENTION

[1. First Embodiment]

[1-1. Structure of First Embodiment]

Figures 1A, 1B, 1C, 1D, 1E, 1F:
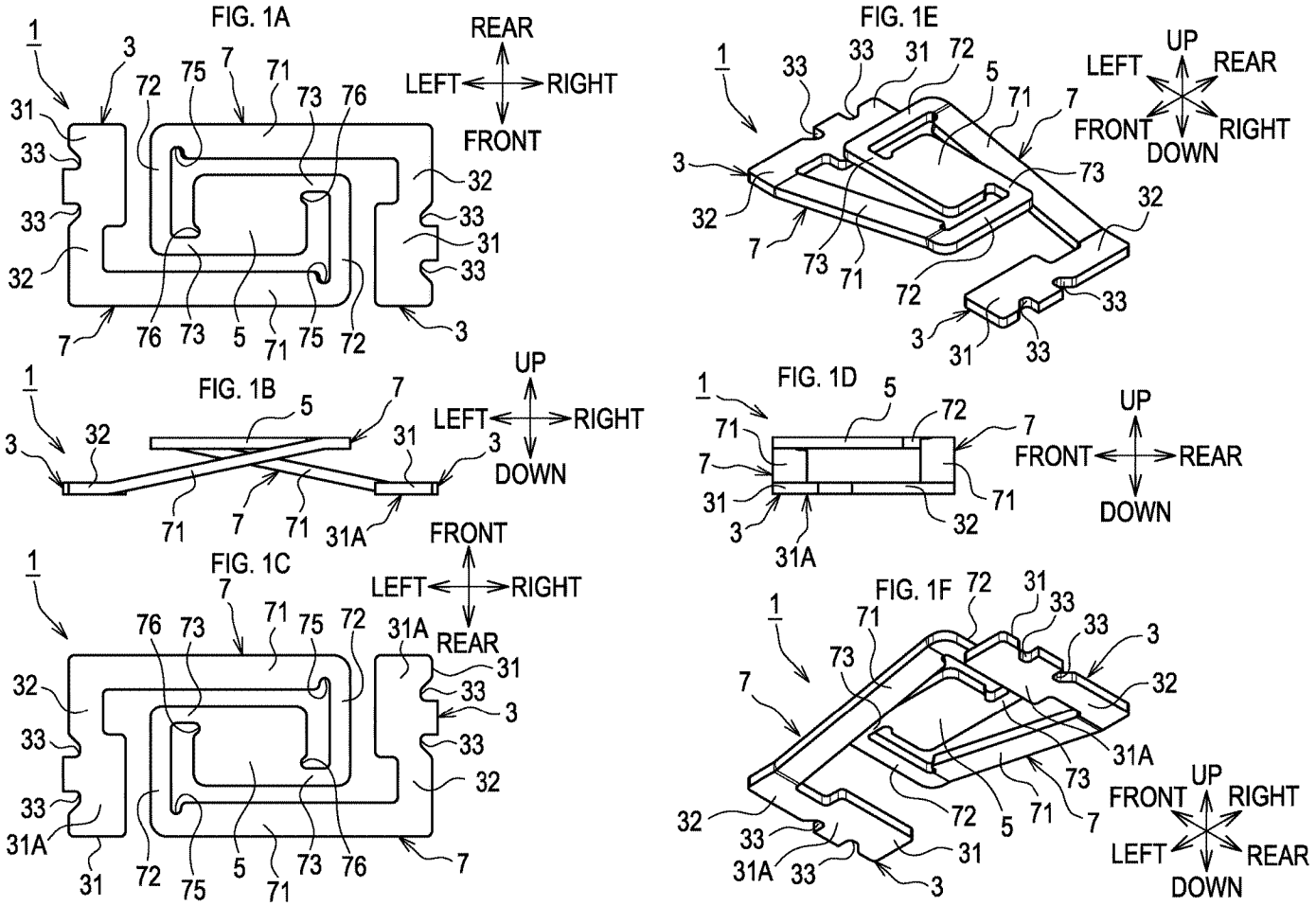
FIG. 1 is a drawing showing a structure of a contact member according to a first embodiment to which the present disclosure is applied, where (A) is a plan view, (B)

Hereinafter, embodiments of the present disclosure will be described with reference to the drawings. FIG. 1 (A) to FIG. 1 (F) show a structure of a contact member 1 as a first embodiment to which the present disclosure is applied. The contact member 1 is formed of a single thin plate made of a metal (for example, phosphor bronze, beryllium copper, SUS (Special Use Stainless steel), or the like) having spring properties. The thin plate is punched out into a specified shape and bent.

As shown in FIG. 1 (A) to FIG. 1 (F), the contact member 1 comprises: a pair of solder bonding portions 3 to be solder-bonded onto a printed wiring board (not shown); a contact portion 5 to contact a conductive member (for example, a shielding plate, a casing or the like), which is different from the printed wiring board; and a pair of flat spring portions 7 each coupling the corresponding solder bonding portion 3 and the contact portion 5. In the descriptions hereafter, directions orthogonal to each solder bonding portion 3 formed in a flat plate shape is referred to as upward and downward directions for convenience.

Specifically, a direction in which a soldering surface 31A of the solder bonding portion 3 is facing (that is, a direction facing the printed wiring board) is referred to as a downward direction for convenience. Further, directions in which the pair of solder bonding portions 3 are facing each other is referred to as left and right directions for convenience. Such directions are designated tentatively for convenience of the descriptions, and an arrangement and a position of the contact member 1 should not be limited to such directions.

The solder bonding portion 3 comprises a main body 31 and an extension portion 32, which are connected to each other in front and rear directions. The solder bonding portion 3 has a flat plate shape as a whole. The main body 31 has a shape of a substantial rectangle, whose long sides are at both ends in the right and left directions. A pair of cutouts 33 are formed on an outer side of the main body 31 in the right and left directions (specifically, on the right side of the main body 31 located on the right, and on the left side of the main body 31 located on the left). Each cutout 33 is formed in a rounded right triangle shape. A shorter side of the two perpendicular sides of the cutout 33 is arranged to be facing a side where the cutouts 33 are adjacent to each other, whereas a longer side is arranged to be facing the outer side of the main body 31 in the right and left directions.

The extension portion 32 has a shape of a substantial rectangle that is one size smaller than the main body 31 both in the front and rear directions and in the right and left directions. The extension portion 32 is connected to the main body 31 with an outer side of the extension portion 32 in the right and left directions being aligned with the outer side of the main body 31 in the right and left directions. In the contact member 1, the solder bonding portion 3 on the right is arranged so as to have the main body 31 on the front side, whereas the solder bonding portion 3 on the left is arranged so as to have the main body 31 on the rear side. In the two solder bonding portions 3, a front end of the main body 31 of the solder bonding portion 3 on the right is aligned, in the front and rear directions, with a front end of the extension portion 32 of the solder bonding portion 3 on the left. A rear end of the main body 31 of the solder bonding portion 3 on the left is aligned, in the front and rear directions, with a rear end of the extension portion 32 of the solder bonding portion 3 on the right. In the present embodiment, an undersurface of the main body 31 is the soldering surface 31A, which is a target of solder application, and an undersurface of the extension portion 32 is not a target of solder application.

The contact portion 5 is arranged between the pair of solder bonding portions 3 in plan view, and is formed in a rectangle-like plate shape with its long sides on both ends in the front and rear directions. One of the flat spring portions 7 is arranged between a front left corner of the contact portion 5 and a rear end of a left surface of the extension portion 32 of the solder bonding portion 3 on the right. The other of the flat spring portions 7 is arranged between a rear right corner of the contact portion 5 and a front end of a right surface of the extension portion 32 of the solder bonding portion 3 on the left. In other words, each flat spring portion 7 is arranged between an end section of the corresponding extension portion 32 of the corresponding solder bonding portion 3 and the corner, among the four corners, of the contact portion 5, which is farthest from the corresponding end section. The shape and arrangement of each spring portion 7 and the corresponding solder bonding portion 3 correspond to those of the other flat spring portion 7 and the other solder bonding portion 3 when rotated by 180 degrees around an axis passing through the center of the contact portion 5 in the upward and downward directions.

Each flat spring portion 7 comprises three sections in order starting from the side of the corresponding solder bonding portion 3: a first section 71, a second section 72, and a third section 73. The first section 71 is formed in a belt-like shape extending in the right and left directions. One end (one example of a leading-end section) of the first section 71 is connected to the end section of the extension portion 32, whereas the other end lies close to the other solder boding portion 3. The second section 72 is formed in a belt-like shape extending in the front and rear directions. One end of the second section 72 is connected to the above-described other end of the first section 71, whereas the other end lies close to the above-described corner of the contact portion 5 to which this flat spring portion 7 is to be connected. The third section 73 protrudes in a belt-like fashion from an end surface (that is, a side surface) of the above-described corner in the right and left directions, and is connected to the above-described other end of the second section 72.

As for a width of each section (that is, a length orthogonal to an extending direction and to a thickness direction of each belt-like-shaped structure), the widths of the first section 71, the second section 72, and the third section 73 decrease in this order. The rigidities of the first section 71, the second section 72, and the third section 73 decrease in this order. Although the first section 71 is tilted so as to extend diagonally upward from the extension portion 32, the second section 72 and the third section 73 are provided on the same plane as the contact portion 5. Arranged to each first section 71, at a connecting section with the second section 72, is a cutout 75 having an arc-like shape made along a side surface of the second section 72 on the side of the contact portion 5. Arranged to the contact portion 5, at a connecting section with each third section 73, is a cutout 76 having an arc-like shape made along an inner side surface of the third section 73. The rigidity of the flat spring portion 7 in areas where the cutouts 75 and 76 are arranged is locally small.

[1-2. Effects of First Embodiment]

The contact member 1 having the above-described structure is surface-mounted onto the printed wiring board by applying solder to the soldering surface 31A and soldering the soldering surface 31A on a conductive pattern of the printed wiring board. In this way, the contact portion 5 and the solder bonding portions 3 are positioned on respective planes orthogonal to the upward and downward directions, and the contact portion 5 is supported via the flat spring portion 7 above the printed wiring board and the solder bonding portions 3.

Under such conditions, while the contact portion 5 is being pressed by the conductive member such as a shielding plate, the respective flat spring portions 7 are elastically deformed and the contact portion 5 is brought in press contact with the conductive member. As described above, the shape and arrangement of each flat spring portion 7 and the corresponding solder bonding portion 3 correspond to those of the other flat spring portion 7 and the other solder bonding portion 3 when rotated by 180 degrees around the axis passing through the center of the contact portion 5 in the upward and downward directions. That is, each flat spring portion 7 and the corresponding solder bonding portion 3 as a whole take the same shape and the same arrangement with those rotated around the above-described axis by 180 degrees. Thus, when the contact portion 5 is pressed by the conductive member, the contact portion 5 moves downward with its position parallel to the solder bonding portion 3 maintained. This inhibits contact of the contact portion 5 with the solder bonding portion 3 and so on in the process of the pressing, as in the case of the structure described in Patent Document 1. As a result, the mounted contact member 1 can be successfully flattened toward the printed wiring board. Moreover, in sectional shapes of respective sections of each flat spring portion 7, the above-described width (namely, a transverse width) is larger than a thickness in the upward and downward directions. Therefore, as compared with a case in which for example a part of the flat spring portion 7 in a transverse width direction is standing at right angle, the contact member 1 can be flattened more successfully.

FIG. 2 shows the contact member 1 flattened by pressing the contact portion 5 is indicated with solid lines. Even after the contact member 1 is flattened to an extent that the contact portion 5 and the respective solder bonding portions 3 are aligned on the same plane, the contact member 1 can return to its original shape. FIG. 2 shows, however, a state of the contact member 1 in the process of being flattened to such an extent with the solid lines for convenience. FIG. 2 also shows the contact member 1 in which no pressing force is applied to the contact portion 5 with dashed-two dotted lines. As shown in FIG. 2, when no pressing force is applied to the contact portion 5, a distance between a top surface of the contact portion 5 and the soldering surface 31A (so-called item height) is A (approximately 0.5 mm). When the contact member 1 is flattened as described above, the item height indicated as B gradually decreases along with an increase in the applied pressing force, and finally the item height changes into 0.1 mm, which is equal to a thickness of the thin plate as a material of the contact member 1. In the contact member 1, the cutouts 33 are arranged in the solder bonding portion 3 so as to allow redundantly applied solder to escape, whereby the solder bonding portion 3 can be inhibited from being elevated from the printed wiring board due to the redundantly applied solder. Furthermore, as described above, when the contact member 1 is flattened, the contact portion 5 and the solder bonding portions 3 remain parallel to each other, whereby defects of the contact member 1, such as permanent deformation, can also be inhibited.

The respective flat spring portions 7 protrude from side surfaces of the mutually opposed corners of the contact portion 5. Sections following the protruded sections (that is, bases of the third sections 73 connected to the contact portion 5) are bent so as to wind in the same direction (in this case, clockwise in plan view) around a pillar-shaped space obtained by projecting the contact portion 5 downward (that is, in the direction from the top surface of the contact portion 5 as one surface toward an undersurface of the contact portion 5 as the other surface). Further, since the rigidities of the first section 71, the second section 72, and the third section 73 of the flat spring portion 7 decrease in steps in this order, warpage caused by elastic deformation of each flat spring portion 7 is absorbed on a side near the contact portion 5. For this reason, the respective flat spring portions 7 are inhibited from deforming in an outward direction, which successfully inhibits an area of the contact member 1 as projected on the printed wiring board from increasing due to such deformation of the flat spring portions 7. As a result, a mounting area of the contact member 1 can be successfully reduced.

The contact member 1 takes a shape in plan view as shown in FIG. 3 (A) when no pressing force is applied to the contact portion 5. When pressing force is applied to the contact portion 5, the contact member 1 having the above-described structure deforms so as to rotate the contact portion 5 counter-clockwise in plan view as shown in FIG. 3 (B). At this point, the flat spring portions 7 deform so as to be wound inward (that is, toward the contact portion 5) in plan view. For this reason, the area of the contact member 1 as projected on the printed wiring board is inhibited from increasing by the deformation of the flat spring portions 7, and the mounting area of the contact member 1 can be successfully reduced. Such an effect is more successfully exhibited by following aspects: where the first section 71 of each flat spring portion 7 is designed to tilt downward into an area positioned between the two solder bonding portions 3; and where bending positions of each flat spring portion 7 at the time of the elastic deformation are defined by the cutouts 75 and 76. Furthermore, the above-described rotation of the contact portion 5 is smoothly performed due to sufficient space arranged between the contact portion 5 and the respective sections of the flat spring portions 7.

Additionally, the above-described rotation of the contact portion 5 at the time of being pressed enables removal of dirt and rust, so-called self-cleaning, on a surface of the conductive member, such as a shielding plate, which is in contact with the contact portion 5. Also, as shown in FIG. 3 (A) and FIG. 3 (B), such a rotation is so slight that a risk of adversely scratching the surface of the conductive member is inhibited. Moreover, since the contact member 1 is configured such that the contact portion 5 is flattened while rotating as described above, it is possible to inhibit warpage caused in the flat spring portions 7 when the contact portion 5 is flattened from affecting the solder bonding portions 3. That is, appropriate designing of the rigidities of the flat spring portions 7 makes it possible to inhibit the solder bonding portions 3 from being subjected to load when the contact member 1 is flattened.

Further, in this contact member 1, since the respective flat spring portions 7 are arranged bent so as to wind around the above-described pillar-shaped space, it is easy to design the flat spring portion 7 to have a longer length with respect to the same mounting area. Also, since there are the two flat spring portions 7, credibility of the contact member 1 in grounding and so on can be improved.

A contact member of this kind is mounted onto the printed wiring board using a well-known automatic mounter in some cases. In the contact member 1, the top surface of the contact portion 5 is used as a surface to be sucked by a suction nozzle of the automatic mounter. When the top surface of the contact portion 5 is larger than a hole of the suction nozzle, the contact member 1 can be successfully sucked by the suction nozzle. Thus, the mounting area of the contact member 1 can be more successfully reduced. Also, the center of the contact portion 5 is arranged immediately above the center of gravity of the contact member 1, which can successfully inhibit the contact member 1 from tilting while being sucked and transferred by the suction nozzle of the auto mounter.

In a conventional contact member, when a top surface of a solder bonding portion is used as a surface to be sucked by the suction nozzle, the contact member may tilt while being sucked and transferred in some cases due to deviation between the surface to be sucked and the center of gravity of the contact member. Although in case of a typical automatic mounter, an angle of a member to be sucked and transferred in plan view can be corrected, such tilt cannot be corrected. When the contact member remains tilted while being transferred, the contact member may collide with an unexpected section of a circuit. However, the present embodiment can successfully inhibit such a situation from occurring.

Each flat spring portion 7 is connected to the extension portion 32, which is not the target of solder application. Therefore, even if solder protrudes from and solidifies outside the soldering surface 31A of the solder bonding portion 3, the protruded solder is inhibited from reaching a connecting section with the flat spring portion 7. For this reason, redundant solder can be inhibited from affecting the deformation of the flat spring portion 7, which improves a restoration rate of the flat spring portion 7. Moreover, as described above, the cutouts 33 are arranged so as to allow solder to escape, which also can inhibit redundantly applied solder from flowing toward the extension portion 32. Accordingly, even if solder is applied redundantly, each flat spring portion 7 can be deformed relatively successfully.

The contact portion 5 is formed in the rectangle-like plate shape and each flat spring portion 7 has a shape obtained by coupling the belt-like-shaped flat springs (specifically, the first section 71, the second section 72, and the third section 73) provided along the respective sides of the above-described rectangle-like plate shape. Thus, when the contact portion 5 is pressed by the conductive member, each section of the flat spring portion 7 deforms with its plane shape maintained in relatively many areas of the section. Accordingly, as compared with a case where each section of the flat spring portion 7 deforms in a curved manner, the contact member 1 of the present embodiment can be flattened toward the printed wiring board more successfully. Further, the flat spring portions 7, which is bent along the respective sides of the contact portion 5 having the rectangular shape as described above, are easily manufactured by press working. Furthermore, since the contact member 1 is formed of the single thin metal plate being bent and processed by press working or the like, it is possible to simplify a manufacturing process and to further reduce a manufacturing cost. Also, since the contact member 1 as a whole takes substantially the same shape as that when rotated by 180 degrees around the above-described axis, the structure is simplified and easily designed.

[2. Second Embodiment]

A contact member 101 of a second embodiment shown in FIG. 4 (A) to FIG. 4 (F) differs from the contact member 1 in a structure of a contact portion 105 and in a structure of respective flat spring portions 107 as follows. Specifically, the contact portion 105 is larger than the contact portion 5 of the first embodiment in the right and left directions so as to have a size substantially with the second sections 72 of the flat spring portions 7 of the first embodiment integrated. Thus, the third sections 73 are not provided to the respective spring portions 107. The respective second sections 72 protrude from an end surface on the front side of the contact portion 105 and from an end surface on the rear side of the contact portion 105.

Effects similar to those brought about in the contact member 1 are also brought about in the contact member 101 having the above-described structure. However, since the length of the flat spring portion 107 as a whole is smaller as compared with that of the flat spring portions 7, smoothness in motion at the time of elastic deformation decreases in some cases. On the other hand, in the contact member 101 having the above-described structure, its structure can be simplified and its manufacturing cost can be more successfully reduced in some cases.

[3. Third Embodiment]

A contact member 201 of a third embodiment shown in FIG. 5 (A) to FIG. 5 (F) differs from the contact member 1 in a structure of respective solder bonding portions 203, in a structure of a contact portion 205, and in a structure of respective flat spring portions 207 as follows. Specifically, each solder bonding portion 203 is formed in a simple rectangle-like plate shape having its long sides at both ends in the right and left directions, and its entire undersurface is used as a soldering surface 203A. The contact portion 205 is formed in a substantially square-like plate shape having its respective sides in the front and rear directions and in the right and left directions.

Each flat spring portion 207 is formed so as to couple an end section of the corresponding solder bonding portion 203 and a corner, among four corners, of the contact portion 205, which is farthest from the above-described end section, in a smoothly curved manner in plan view. More specifically, one of the flat spring portions 207 starts from a rear end of a left side surface of the solder bonding portion 203 on the right, goes around a rear side of the contact portion 205, and is connected to a front end of a left side surface of the contact portion 205. The other of the flat spring portions 207 starts from a front end of a right side surface of the solder bonding portion 203 on the left, goes around a front side of the contact portion 205, and is connected to a rear end of a right side surface of the contact portion 205. Each flat spring portion 207 entirely tilts upward from the corresponding solder bonding portion 203.

Effects similar to those brought about in the contact member 1 are also brought about in the contact member 201 having the above-described structure. However, since the flat spring portion 207 is formed in the curved shape in plan view, a degree of design freedom increases in some cases. On the other hand, since the flat spring portion 207 is formed in the curved shape in plan view, it may be difficult to apply press working or the like. In the present embodiment, the rigidity of each flat spring portion 207 may change continuously so as to gradually decrease as being closer to the contact portion 205. In such a case, the width of each flat spring portion 207 gradually decreases as being closer to the contact portion 205.

[4. Other Embodiments]

The present disclosure should not be limited to the aforementioned embodiments and can be implemented in various forms within a scope not departing from the gist of the present disclosure.

[4A] For example, a contact member may be formed in a shape having a mirror image relation with respect to the contact members 1, 101, or 201 of the aforementioned embodiments. Even in the contact member having such a structure, effects similar to those brought about in the contact member 1, 101, or 201 are also brought about. Sizes of respective sections of the contact member may also be changed appropriately. A conductive member may be a shielding plate, a casing, or the like as described above, or a printed wiring board other than the printed wiring board on which the contact member is mounted. Although the flat spring portion 7 as a whole tilts in the upward and downward directions by the tilt of the first section 71 in the upward and downward directions in the first embodiment, all of the first section 71, the second section 72, and the third section 73 may tilt.

[4B] In the aforementioned embodiments, all of the contact portion 5, 105, and 205 are formed in the flat plate shape. However, a relatively small convex portion may be provided on a top surface of the contact portion. The convexity is small enough not to interrupt electrical conduction between the conductive member and the contact portion. In such a case, the above-described so-called self-cleaning may be performed more effectively in some cases. When rotation of the contact portion is extremely slight as in the first embodiment, even with such a convex portion provided, the risk of adversely scratching a surface of the conductive member is inhibited.

[4C] In the aforementioned embodiments, the two flat spring portions are provided. However, three or more flat spring portions may be provided. In such a case, each flat spring portion may be provided with a solder bonding portion, or a plurality of the flat spring portions may be provided to one solder bonding portion. Also in the aforementioned embodiments, front ends of the solder bonding portions 3 or 203 or rear ends of the solder bonding portions 3 or 203 may be coupled with each other by using a belt-like plate portion. Alternatively, both the front ends and the rear ends of the solder bonding portions 3 or 203 may be coupled with each other by using belt-like plate portions. As a result, the solder bonding portions may be integrated.

[4D] The cutouts 75 and 76 may be omitted. However, in case that the above-described respective flat spring portions have the cutouts for the purposes of locally reducing the rigidities and utilizing such portions as bending positions at the time of the elastic deformation, the cutouts can define the bending positions at the time of the elastic deformation of the respective flat spring portions. In such a case, the deformation of the respective flat spring portions, in which the mounting area of the contact member increases, is more successfully inhibited, so that the mounting area of the contact member can be more successfully reduced.

[4E] A contact portion may be formed in a disc-like shape, in a polygon-like plate shape such as a triangle-like plate shape or a pentagon-like plate shape, or in other irregular plate shape. However, as is the case with the first embodiment, when the above-described contact portion is formed in the rectangle-like plate shape and each flat spring portion 7 has a shape obtained by coupling the belt-like-shaped flat springs provided along the respective sides of the above-described rectangle-like plate shape, it is easy to manufacture the contact member by press working.

The above-described contact member may be formed by a plurality of parts being combined together. However, as is the case with the aforementioned embodiments, when the above-described contact member is formed of the single thin metal plate being bent, a manufacturing process of the contact member can be simplified, to thereby further reduce a manufacturing cost.

[4F] A function/functions performed by one element in the aforementioned embodiments may be performed by a plurality of elements, or a function/functions performed by a plurality of elements may be integrated to be performed by one element. At least part of the structure of the aforementioned embodiments may be replaced with a known structure having a similar function. Part of the structure of the aforementioned embodiments may be omitted. At least part of the structure of the aforementioned embodiments may be added to or substituted with a structure of other embodiments described above. Any modes included in the technical ideas specified only by the claim language are embodiments of the present disclosure.

EXPLANATION OF REFERENCE NUMERALS

| | |
|---|---|
| 1, 101, 201 . . . contact member | 3, 203 . . . solder bonding portion |
| 5, 105, 205 . . . contact portion | 7, 107, 207 . . . flat spring portion |
| 31 . . . main body | 31A, 203A . . . soldering surface |
| 32 . . . extension portion | 33, 75, 76 . . . cutout |

The invention claimed is:

1. A contact member formed by bending a thin metal plate, the contact member being surface-mounted onto a mounting target surface of a printed wiring board when in use and being sandwiched between the printed wiring board and a conductive member, which is different from the printed wiring board, to thereby electrically connect a conductive pattern of the printed wiring board and the conductive member to each other, the contact member comprising:

a contact portion formed in a flat plate shape with one surface thereof serving both as a surface to contact the conductive member and as a surface to be sucked by a suction nozzle of an automatic mounter;

a plurality of flat spring portions protruding from a plurality of respective places on side surfaces of the contact portion, sections following protruded sections of the respective flat spring portions being arranged so as to wind in a same direction around a pillar-shaped space obtained by projecting the contact portion in a direction from the one surface of the contact portion toward the other surface, each flat spring portion tilting as a whole in the direction from the one surface toward the other surface; and a solder bonding portion arranged at an end section of each flat spring portion on a side opposite from the corresponding protruded section, the solder bonding portion being formed in a flat plate shape parallel to the contact portion and being solder-bonded onto the conductive pattern.

2. The contact member according to claim 1, wherein in sectional shapes of respective sections of each flat spring portion, a width in a direction along the one surface is larger than a thickness in a direction along an axis of the pillar-shaped space.

3. The contact member according to claim 1, wherein the solder bonding portion is provided for each flat spring portion, wherein each flat spring portion and the corresponding solder bonding portion as a whole take a same shape and a same arrangement as those rotated by 360/n degrees (n is an integer equal to or greater than 2) around an axis standing orthogonally to the one surface and passing a center of the contact portion, and wherein the solder bonding portions are provided independently of each other at the end sections of the corresponding flat spring portions.

4. The contact member according to claim 1, wherein the solder bonding portion comprises an extension portion that is extended in a direction protruding from a side surface of a main body of the solder bonding portion, the main body being a target of solder application, the extension portion not being a target of solder application, and wherein each end section of the corresponding flat spring portion is connected to the extension portion.

5. The contact member according to claim 1, wherein a rigidity of each flat spring portion increases continuously or in steps throughout from the protruded section toward the end section.

* * * * *